US009426872B1

(12) United States Patent
Riggs et al.

(10) Patent No.: US 9,426,872 B1
(45) Date of Patent: Aug. 23, 2016

(54) SYSTEM AND METHOD FOR CONTROLLING SOURCE LASER FIRING IN AN LPP EUV LIGHT SOURCE

(71) Applicant: ASML Netherlands B.V., Veldhoven (NL)

(72) Inventors: Daniel Jason Riggs, San Diego, CA (US); Robert Jay Rafac, Encinitas, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/824,267

(22) Filed: Aug. 12, 2015

(51) Int. Cl.
*H05G 2/00* (2006.01)
*B05B 12/02* (2006.01)
*B05B 17/06* (2006.01)

(52) U.S. Cl.
CPC ..... *H05G 2/008* (2013.01); *H05G 2/003* (2013.01)

(58) Field of Classification Search
CPC ..... H05G 2/008; H05G 2/003; H05G 2/005; H05G 2/006; G06F 7/70033; G06F 7/20; G06F 7/2006; G06F 7/70041; G06F 7/7085; G21K 5/00; G21K 5/08; B05B 12/02; H01J 37/228; H01J 37/3045; H01L 21/268; H01L 22/10
USPC ..... 250/504 R, 372, 205, 214.1, 492.1; 372/18, 27, 29.014, 30, 55; 378/119, 378/143, 34
See application file for complete search history.

(56) References Cited

U.S. PATENT DOCUMENTS 6,377,651 B1 * 4/2002 Richardson ..... B82Y 10/00 378/119
8,653,437 B2 * 2/2014 Partlo ..... G03F 7/70033 250/205
8,809,823 B1 * 8/2014 Senekerimyan ..... H05G 2/008 250/504 R
8,847,181 B2 * 9/2014 Moriya et al. ..... H05G 2/003 250/504 R
8,872,122 B2 * 10/2014 Schafgans ..... H05G 2/003 250/372
8,927,952 B2 * 1/2015 Rafac ..... G21K 5/00 250/504 R
9,072,153 B2 * 6/2015 Wakabayashi ..... H05G 2/00 250/504 R
9,113,540 B2 * 8/2015 Hori ..... H01S 3/10061 250/504 R (Continued)

*Primary Examiner* — David A Vanore
(74) *Attorney, Agent, or Firm* — Gard & Kaslow LLP

(57) ABSTRACT

Methods and systems for improved timing of a source laser in a laser produced plasma (LPP) extreme ultraviolet (EUV) generation system are disclosed. Due to forces within the plasma chamber, a velocity of a droplet can slow as it approaches the irradiation site. Because the droplet is slowed, a source laser fires prematurely relative to the slowed droplet, resulting in only a leading portion of the droplet being irradiated. The resulting amount of EUV energy generated from the droplet is proportional to the slowed velocity of the droplet. To compensate, the firing of the source laser is delayed for a next droplet based on the generated EUV energy. Because the firing of the source laser is delayed for the next droplet, the next droplet is more likely to be in position to be more completely irradiated, resulting in more EUV energy being generated from the next droplet.

20 Claims, 4 Drawing Sheets

(56) References Cited

U.S. PATENT DOCUMENTS 9,167,678 B2 * 10/2015 Hori ..... H01S 3/10061
9,198,272 B2 * 11/2015 Nakano ..... H05G 2/008
9,277,635 B2 * 3/2016 Moriya ..... H05G 2/005
2012/0243566 A1 * 9/2012 Hori ..... H01S 3/10061
372/27
2014/0084183 A1 * 3/2014 Wakabayashi ..... H05G 2/008
250/492.1
2014/0098830 A1 * 4/2014 Yabu ..... H05G 2/005
372/30
2015/0043599 A1 * 2/2015 Yanagida ..... H01S 3/1106
372/18
2015/0102239 A1 * 4/2015 Yanagida ..... H05G 2/005
250/504 R
2015/0296604 A1 * 10/2015 Nagai ..... H05G 2/006
250/504 R
2016/0037616 A1 * 2/2016 Saito ..... H05G 2/005
250/504 R
2016/0066401 A1 * 3/2016 Yabu ..... H05G 2/006
250/504 R
2016/0073487 A1 * 3/2016 Yanagida ..... H05G 2/006
250/504 R
2016/0087389 A1 * 3/2016 Niwano ..... H01S 3/10015
250/504 R

* cited by examiner

SYSTEM AND METHOD FOR CONTROLLING SOURCE LASER FIRING IN AN LPP EUV LIGHT SOURCE

BACKGROUND

1. Field

The present application relates generally to laser produced plasma (LLP) extreme ultraviolet (EUV) light sources, and, more specifically, to a method and system for firing a source laser in an LPP EUV light source.

2. Description of Related Art

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of between 10 and 120 nanometers (nm) with shorter wavelengths expected to be used in the future. EUV lithography is currently generally considered to include EUV light at wavelengths in the range of 10-14 nm, and is used to produce extremely small features, for example, sub-32 nm features, in substrates such as silicon wafers. These systems must be highly reliable and provide cost effective throughput and reasonable process latitude.

Methods to produce EUV light include, but are not necessarily limited to, converting a material into a plasma state that has one or more elements, e.g., xenon, lithium, tin, indium, antimony, tellurium, aluminum, etc., with one or more emission line(s) in the EUV range. In one such method, often termed laser produced plasma ("LPP"), the required plasma can be produced by irradiating a target material, such as a droplet, stream or cluster of material having the desired line-emitting element, with a laser pulse at an irradiation site. The target material may contain the spectral line-emitting element in a pure form or alloy form, for example, an alloy that is a liquid at desired temperatures, or may be mixed or dispersed with another material such as a liquid.

A droplet generator heats the target material and extrudes the heated target material as droplets which travel along a trajectory to the irradiation site to intersect the laser pulse. Ideally, the irradiation site is at one focal point of a reflective collector. When the laser pulse hits the droplets at the irradiation site, the droplets are vaporized and the reflective collector causes the resulting EUV light output to be maximized at another focal point of the collector.

In earlier EUV systems, a laser light source, such as a $CO_2$ laser source, is on continuously to direct a beam of light to the irradiation site, but without an output coupler so that the source builds up gain but does not lase. When a droplet of target material reaches the irradiation site, the droplet causes a cavity to form between the droplet and the light source and causes lasing within the cavity. The lasing then heats the droplet and generates the plasma and EUV light output. In such "NoMO" systems (called such because they do not have a master oscillator) no timing of the arrival of the droplet at the irradiation site is needed, since the system only lases when a droplet is present there.

More recently, NoMO systems have generally been replaced by "MOPA" systems, in which a master oscillator and power amplifier form a source laser which may be fired as and when desired, regardless of whether there is a droplet present at the irradiation site or not, and "MOPA PP" ("MOPA with pre-pulse") systems in which a droplet is sequentially illuminated by more than one light pulse. In a MOPA PP system, a "pre-pulse" is first used to heat, vaporize or ionize the droplet and generate a weak plasma, followed by a "main pulse" which converts most or all of the droplet material into a strong plasma to produce EUV light emission.

One advantage of MOPA and MOPA PP systems is that the source laser need not be on constantly, in contrast to a NoMO system. However, since the source laser in such a system is not on constantly, firing the laser at an appropriate time so as to deliver a droplet and laser pulses to the desired irradiation site simultaneously for plasma initiation presents additional timing and control problems beyond those of prior systems. It is not only necessary for the laser pulses to be focused on an irradiation site through which the droplet will pass, but the firing of the laser must also be timed so as to allow the laser pulses to intersect the droplet when it passes through that irradiation site in order to obtain a good plasma, and thus good EUV light. In particular, in a MOPA PP system, the pre-pulse must target the droplet very accurately.

What is needed is an improved way of controlling and the timing of the source laser, so that when the source laser is fired, the resulting pulse will irradiate the droplets at the irradiation site.

SUMMARY

According to various embodiments, a method for timing the firing of a source laser in an extreme ultraviolet (EUV) laser produced plasma (LPP) light source having a droplet generator which releases a sequence of droplets, the source laser firing pulses at an irradiation site comprises: obtaining a first amount of EUV energy generated from a first pulse of the pulses that impacted a first droplet of the sequence of droplets; determining, from the detected first amount of EUV energy, an anticipated delay of a second droplet of the sequence of droplets reaching the irradiation site; and modifying a timing of firing a second pulse of the pulses based on the anticipated delay of the second droplet so as to irradiate the second droplet when the second droplet reaches the irradiation site.

According to various embodiments, a system for timing the firing of a source laser in an extreme ultraviolet (EUV) laser produced plasma (LPP) light source having a droplet generator which releases a sequence of droplets, the source laser firing pulses at an irradiation site comprises: an EUV energy detector configured to obtain a first amount of EUV energy generated from a first pulse of the pulses that impacted a first droplet of the sequence of droplets; and a delay module configured to: determine, from the detected first amount of EUV energy, an anticipated delay of a second droplet of the sequence of droplets reaching the irradiation site, and instruct the source laser to modify a timing of firing a second pulse of the pulses based on the anticipated delay of the second droplet so as to irradiate the second droplet when the second droplet reaches the irradiation site.

According to various embodiments, a non-transitory machine-readable medium having instructions embodied thereon, the instructions executable by one or more machines to perform operations for timing the firing of a source laser in an extreme ultraviolet (EUV) laser produced plasma (LPP) light source having a droplet generator which releases a sequence of droplets, the source laser firing pulses at an irradiation site, the operations comprise: obtaining a first amount of EUV energy generated from a first pulse of the pulses that impacted a first droplet of the sequence of droplets; determining, from the detected first amount of EUV energy, an anticipated delay of a second droplet of the sequence of droplets reaching the irradiation site; and modifying a timing of firing a second pulse of the pulses based on the anticipated delay of the second droplet so as to irradiate the second droplet when the second droplet reaches the irradiation site.

DETAILED DESCRIPTION

In LPP EUV systems, droplets of a target material travel sequentially from a droplet generator to an irradiation site, where each is irradiated by a pulse from a source laser. If the pulse fails to impact a droplet, no EUV light is generated. If the pulse successfully impacts the droplet, a maximum amount of EUV light is generated. Between these two extremes, when the pulse impacts only a portion of the droplet, a lower amount of EUV light is generated. As such, it is desirable to time the pulses so that they successfully impact the droplets, maximizing the amount of EUV energy generated.

When irradiated, the droplet converts to a plasma which causes subsequent droplets to slow as they approach the irradiation site. Without adjusting for this effect, the source laser fires pre-maturely (relative to the slowed droplet) and a smaller amount of EUV light is generated because only the leading edge of the droplet is irradiated.

To compensate for the slowing of the droplet, the firing of the source laser is delayed. To determine an appropriate amount of time to delay the pulse, the EUV energy generated from the impact of one or more preceding droplets with previous laser pulses is obtained or determined. Using a weighted sum or a low pass filter, the amount of time to delay the firing of the pulse is determined based on the obtained or determined EUV energy. The source laser is then instructed to fire accordingly.

Figure 1:
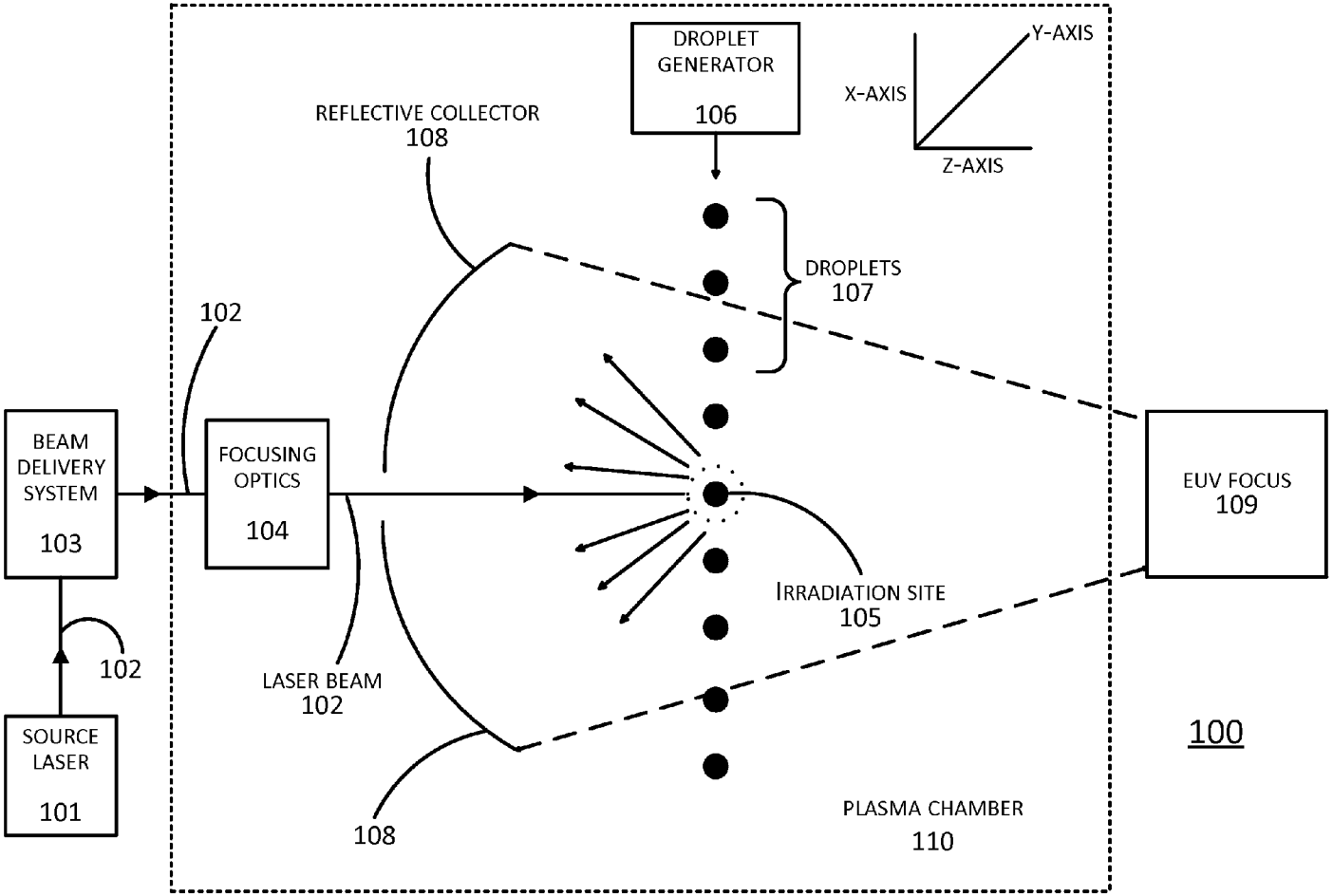
FIGURE 1 (Prior art)
FIG. 1 is an illustration of some of the components of a typical prior art embodiment of an LPP EUV system.

FIG. 1 illustrates a cross-section of some of the components of a typical LPP EUV system 100 as is known in the prior art. A source laser 101, such as a $CO_2$ laser, produces a laser beam (or a sequence of pulses) 102 that passes through a beam delivery system 103 and through focusing optics 104. Focusing optics 104 may, for example, be comprised of one or more lenses or other optical elements, and has a nominal focal spot at an irradiation site 105 within a plasma chamber 110. A droplet generator 106 produces droplets 107 of an appropriate target material that, when hit by laser beam 102, produces a plasma which emits EUV light. In some embodiments, there may be multiple source lasers 101, with beams that all converge on focusing optics 104.

Irradiation site 105 is preferably located at a focal spot of collector 108, which has a reflective interior surface and focuses the EUV light from the plasma at EUV focus 109, a second focal spot of collector 108. For example, the shape of collector 108 may comprise a portion of an ellipsoid. EUV focus 109 will typically be within a scanner (not shown) containing pods of wafers that are to be exposed to the EUV light, with a portion of the pod containing wafers currently being irradiated being located at EUV focus 109.

For reference purposes, three perpendicular axes are used to represent the space within the plasma chamber 110 as illustrated in FIG. 1. The vertical axis from the droplet generator 106 to the irradiation site 105 is defined as the x-axis; droplets 107 travel generally downward from the droplet generator 106 in the x-direction to irradiation site 105, although as described above in some cases the trajectory of the droplets may not follow a straight line. The path of the laser beam 102 from focusing optics 104 to irradiation site 105 in one horizontal direction is defined as the z-axis, and the y-axis is defined as the horizontal direction perpendicular to the x-axis and the z-axis.

As above, in some prior art embodiments, a closed-loop feedback control system may be used to monitor the trajectory of the droplets 107 so that they arrive at irradiation site 105. Such a feedback system again typically comprises a line laser which generates a planar curtain between the droplet generator 106 and irradiation site 105, for example by passing the beam from the line laser through a combination of spherical and cylindrical lenses. One of skill in the art will appreciate how the planar curtain is created, and that although described as a plane, such a curtain does have a small but finite thickness.

Figure 2:
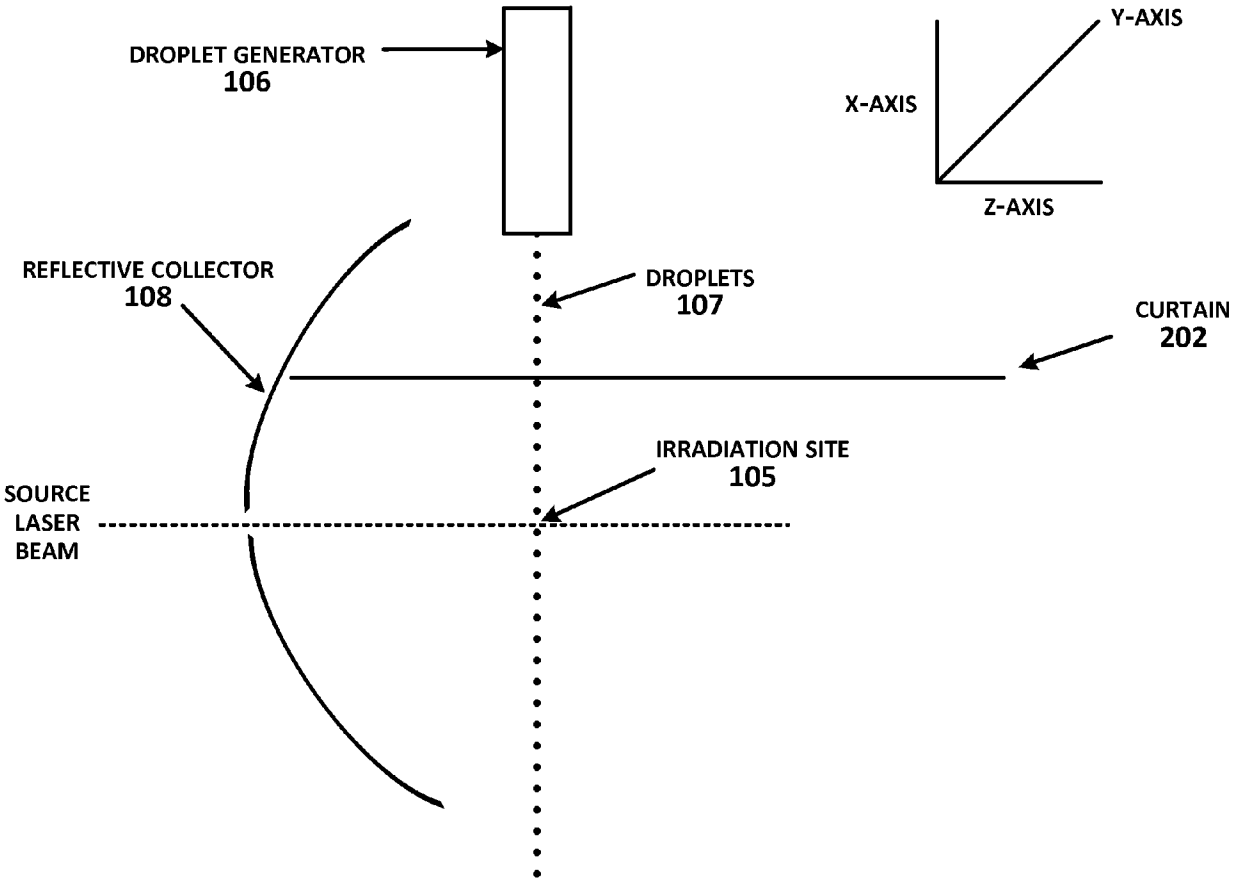
FIGURE 2 (Prior art)
FIG. 2 is a simplified illustration showing some of the components of another prior art embodiment of an LPP EUV system.

FIG. 2 is a simplified illustration showing some of the components of a prior art LPP EUV system such as is shown in FIG. 1, with the addition of a planar curtain 202 which may be created by a line laser (not shown) as described above. Curtain 202 extends primarily in the y-z plane, i.e., the plane defined by the y- and z-axes (but again has some thickness in the x-direction), and is located between the droplet generator 106 and irradiation site 105.

When a droplet 107 passes through curtain 202, the reflection of the laser light of curtain 202 from the droplet 107 creates a flash which may be detected by a sensor (in some prior art embodiments this is called a narrow field, or NF, camera, not shown) and allows the droplet position along the y- and/or z-axis to be detected. If the droplet 107 is on a trajectory that leads to the irradiation site 105, here shown as a straight line from the droplet generator 106 to irradiation site 105, no action is required. In some embodiments, curtain 202 may be located about 5 mm from irradiation site 105.

However, if the droplet 107 is displaced from the desired trajectory in either the y- or z-direction, a logic circuit determines the direction in which the droplets should move so as to reach irradiation site 105, and sends appropriate signals to one or more actuators to re-align the outlet of droplet generator 106 in a different direction to compensate for the difference in trajectory so that subsequent droplets will reach irradiation site 105. Such feedback and correction of the droplet trajectory may be performed on the droplets, as is known to one of skill in the art.

As is known in the art, while the laser curtains have a finite thickness, it is preferable to make the curtains as thin as is practical, since the thinner a curtain is the more light intensity it has per unit of thickness (given a specific line laser source), and can thus provide better reflections off the droplets 107 and allow for more accurate determination of droplet position. For this reason, curtains of about 100 microns (measured FWHM, or "full-width at half-maximum," as known in the art) are commonly used, as it is not practical to make thinner curtains. The droplets are generally significantly smaller, on the order of 30 microns or so in diameter, and an entire droplet will thus easily fit within the thickness of the curtain. The "flash" of laser light reflected off of the droplet is a function that increases as the droplet first hits the curtain, reaches a maximum as the droplet is fully contained within the curtain thickness, and then decreases as the droplet exits the curtain.

As is also known in the art, it is not necessary that the curtain(s) extend across the entire plasma chamber 110, but rather need only extend far enough to detect the droplets 107 in the area in which deviations from the desired trajectory may occur. Where two curtains are used, one curtain might, for example, be wide in the y-direction, possibly over 10 mm, while the other curtain might be wide in the z-direction, even as wide as 30 mm, so that the droplets may be detected regardless of where they are in that direction.

Again, one with skill in the art will understand how to use such systems to correct the trajectory of droplets 107 to insure that they arrive at irradiation site 105. As above, in the case of NoMO systems, this is all that is required, since again the droplets 107 themselves form part of a cavity, along with a light source that is continuously on such as a $CO_2$ laser source, to cause lasing and vaporize the target material.

However, in MOPA systems, source laser 101 is typically not generating laser pulses continuously, but rather fires laser pulses when a signal to do so is received. Thus, in order to hit discrete droplets 107 separately, it is not only necessary to correct the trajectory of the droplets 107, but also to determine the time at which a particular droplet will arrive at irradiation site 105 and send a signal to source laser 101 to fire at a time such that a laser pulse will arrive at irradiation site 105 simultaneously with a droplet 107.

In particular, in MOPA PP systems, which generate a pre-pulse followed by a main pulse, the droplet must be targeted very accurately with the pre-pulse in order to achieve maximum EUV energy when the droplet is vaporized by the main pulse. A focused laser beam, or string of pulses, has a finite "waist," or width, in which the beam reaches maximum intensity; for example, a $CO_2$ laser used as a source laser typically has a usable range of maximum intensity of about 10 microns in the x- and y-directions.

Since it is desirable to hit a droplet with the maximum intensity of the source laser, this means that the positioning accuracy of the droplet must be achieved to within about ±5 microns in the x- and y-directions when the laser is fired. There is somewhat more latitude in the z-direction, as the region of maximum intensity may extend for as much as about 1 mm in that direction; thus, accuracy to within ±25 microns is generally sufficient.

The speed (and shape) of the droplets is measured and thus known; droplets may travel at over 50 meters per second. (One of skill in the art will appreciate that by adjusting the pressure and nozzle size of the droplet generator the speed may be adjusted.) The position requirement thus also results in a timing requirement; the droplet must be detected, and the laser fired, in the time it takes for the droplet to move from the point at which it is detected to the irradiation site.

To complicate compliance with the timing requirement, the droplets slow significantly upon approaching the plasma at the irradiation site 105. This slowing can be caused by a number of forces within the plasma chamber 110. Because the slowing of the droplet prevents the droplet from arriving at the irradiation site 105 at an expected time, the droplet is only partially irradiated and less EUV energy is generated from the droplet. The slowing of the droplet thus manifests as, and is proportionally related to, the amount of EUV energy generated from the EUV droplet.

Figure 3:
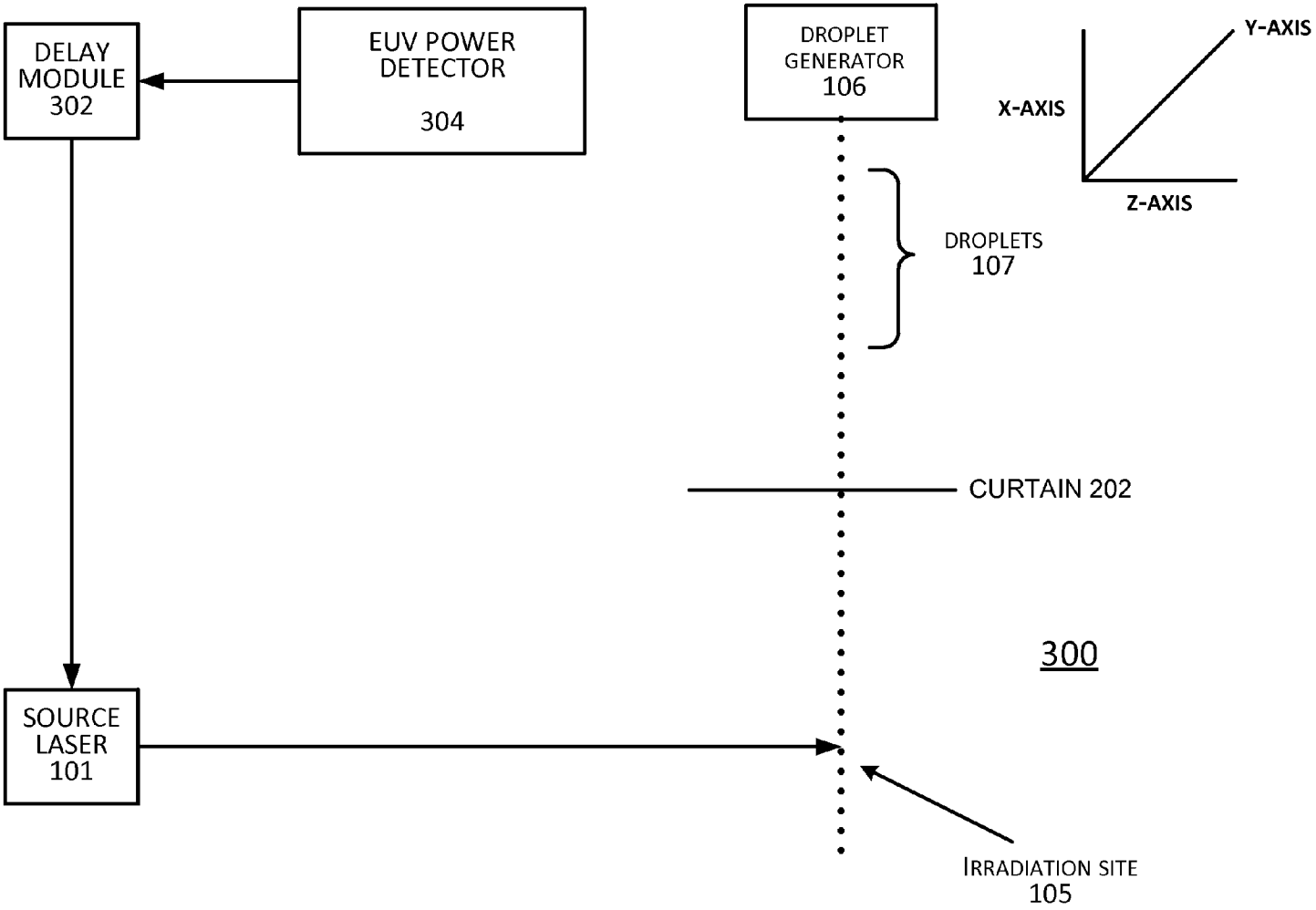
FIG. 3 is a simplified illustration of some of the components of an LPP EUV system including an EUV energy detector and a delay module, according to an embodiment.

FIG. 3 is a simplified illustration of some of the components of an LPP EUV system 300 including an EUV energy detector 304 and a delay module 302, according to an embodiment. System 300 contains elements similar to those in the systems of FIGS. 1 and 2, and additionally includes a delay module 302 and an EUV energy detector 304. One of skill in the art will also appreciate that while FIG. 3 is shown as a cross-section of the system 300 in the x-z plane, in practice the plasma chamber 110 is often rounded or cylindrical, and thus the components may in some embodiments be rotated around the periphery of the chamber while maintaining the functional relationships described herein.

As described above, droplet generator 106 creates droplets 107 which are intended to pass through irradiation site 105, where they are irradiated by pulses from source laser 101. (For simplicity, some elements are not shown in FIG. 3.) The delay module 302 can be implemented in a variety of ways known to those skilled in the art including, but not limited to, as a computing device having a processor with access to a memory capable of storing executable instructions for performing the functions of the described modules. The computing device can include one or more input and output components, including components for communicating with other computing devices via a network or other form of communication. The delay module 302 comprises one or more modules embodied in computing logic or executable code such as software. In other instances, the delay module 302 can be implemented in a field-programmable gate array (FPGA).

The EUV energy detector 304 of the system 300 detects the amount of EUV energy generated in the plasma chamber 110. EUV energy detectors comprise photodiodes and are generally known to those skilled in the art. As is familiar to those skilled in the art, by integrating the EUV power signal provided by the EUV energy detector 304 over the time span that the droplet is irradiated, the EUV energy generated from the impact of the droplet and the laser pulse is calculated.

The delay module 302 is configured to determine, from the amount of EUV energy, an anticipated delay of a next droplet due to the slowing that occurs as the droplet nears the plasma at the irradiation site 105. The anticipated delay is calculated by the formula:

$$T_{delay}=E_{EUV,droplet}*P$$

where $T_{delay}$ is the anticipated delay (in nanoseconds), $E_{EUV,droplet}$ is the amount of EUV energy generated from the immediately preceding droplet, and P is a parameter having the units of $Watt^{-1}$ (i.e., 1/Watt).

In one embodiment, the parameter, P, was calculated by measuring droplet velocity near the irradiation site for different EUV energies. The parameter P was then derived from the slope of a line of the droplet velocity versus EUV energy. This parameter is static, that is, it has been determined that source-specific calibration of this parameter is not needed.

The anticipated delay can be calculated as above, and used to instruct the source laser 101 to delay firing accordingly. The source laser 101, absent an instruction to delay from the delay module 302, can fire pulses at regular intervals coinciding with the intervals at which the droplet generator 106 generates droplets, for example, at a rate of 40-50 kHz. Thus, the source laser 101 fires the pulses at a periodic interval, regardless of whether the anticipated delay is calculated, for example, approximately every 20-25 microseconds. The delay module 302 can modify a preexisting system trigger for firing the laser by adding the calculated anticipated delay and instructing the source laser 101 to fire accordingly. In other embodiments, the delay module 302 can provide the anticipated delay to the source laser 101. The source laser 101 can then itself modify the preexisting system trigger for firing the laser by the anticipated delay.

In some instances, other methods to calculate the anticipated delay can be used. These methods may provide greater accuracy, thus resulting in greater EUV energy generation. In some instances, for example, the amount of EUV generated from a pre-defined number of droplets can be used to calculate the anticipated delay of a next droplet. In other instances, a low pass filter can be applied to the amount of EUV energy generated by previously irradiated droplets to calculate the anticipated delay of the next droplet.

When the amount of EUV generated from a pre-defined number of droplets is used to calculate the anticipated delay, the amount of EUV energy generated from each of the pre-defined number of droplets is obtained. From each amount of EUV energy, an anticipated delay is calculated and scaled using a scaling factor. These scaled delays are combined (e.g., summed) to determine the anticipated delay of the next droplet.

To illustrate, in some instances, the number of droplets between the curtain 202 and the irradiation site 105 is selected as the pre-determined number. In one embodiment, where the curtain 202 is 5 mm from the irradiation site 105, and the droplets are generated at 50 kHz, at a given point in time, three droplets can be travelling between the curtain 202 and the irradiation site 105. In this embodiment, the anticipated delay can be calculated as:

$$T\text{delay}=(E_{EUV,droplet1}*P)+(1/2)(E_{EUV,droplet2}*P)+(1/3)(E_{EUV,droplet3}*P)$$

where $T_{delay}$ is the anticipated delay (in microseconds), $E_{EUV,droplet1}$ is the amount of EUV energy generated from the immediately preceding droplet, $E_{EUV,droplet2}$ is the amount of EUV energy generated by the penultimate droplet, $E_{EUV,droplet3}$ is the amount of EUV energy generated by the droplet preceding the penultimate droplet, and P is a parameter having the units of $\text{Watt}^{-1}$. As will be appreciated by those skilled in the art in light of the description herein, the previous anticipated delay times can be scaled proportionate to their respective 1/r values (where r is a count indicating the order in which the previous droplets arrived at the irradiation site 105, e.g., the most recent droplet is r=1, the droplet before the most recent droplet is r=2, and so on), but other proportions can be used.

In other instances, when a low pass filter is applied to the amount of EUV energy generated by previously irradiated droplets to determine the anticipated delay, a larger number of previous droplets can be included in the calculations. The amount of EUV energy generated from each droplet in a series of droplets is obtained and assembled as a signal that changes over time to which a low pass filter can be applied using techniques known to those skilled in the art. One example of a low pass filter that can be used is an infinite impulse response (IIR) low pass filter. Because the output of the low pass filter indicates energy, a scaling factor can be applied to determine the anticipated delay.

Figure 4:
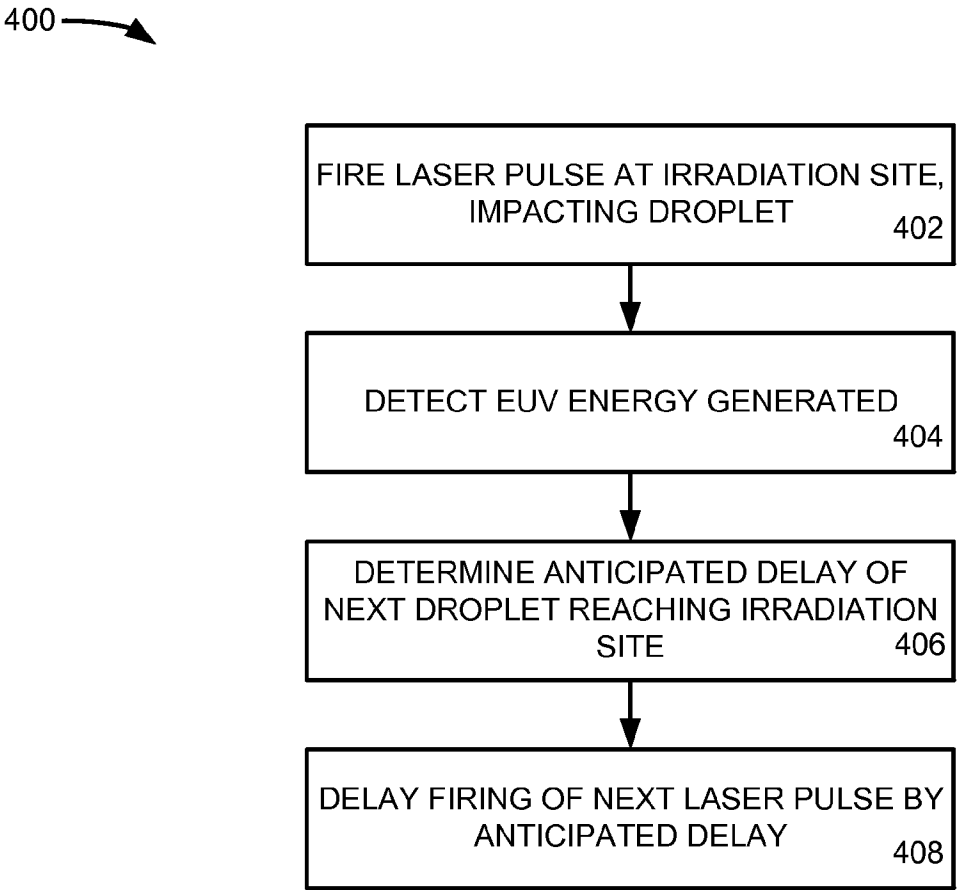
FIG. 4 is a flowchart of a method of timing the pulses of a source laser in an LPP EUV system according to one embodiment.

FIG. 4 is a flowchart of a method 400 of timing the pulses of a source laser in an LPP EUV system according to one embodiment. The method 400 can be performed, at least in part, by the EUV energy detector 304 and the delay module 302.

In an operation 402, a laser pulse is fired at an irradiation site (e.g. irradiation site 105), by, for example, source laser 101, at least partially impacting a droplet.

In an operation 404, the amount of EUV energy generated by the impact is detected by, for example, the EUV energy detector 304. The amount of EUV energy can be obtained from the EUV energy detector 304 as a currently detected value or can be obtained by retrieving a previously stored detected value. As described herein, the amount of EUV generated by the impact is proportional to the relative position of the droplet to the fired pulse.

In an operation 406, the anticipated delay of the next droplet in reaching the irradiation site 105 is determined as described in connection with the delay module 302. The slowing of the droplet is observed to be proportional to the amount of EUV generated by at least the immediately preceding droplet.

In an operation 408, the firing of the next laser pulse by the source laser 101 is delayed based the anticipated delay. In one embodiment, the operation 408 is performed by modifying a periodic interval between the pulses based on the anticipated delay. By delaying the firing of the next laser pulse, the likelihood that the next droplet is irradiated upon reaching the irradiation site is increased.

Note that this flowchart shows the treatment of a single droplet. In practice, the droplet generator is continuously generating droplets as described above. Since there is a sequential series of droplets, there will similarly be a sequential series of anticipated delays generated, thus causing the source laser to fire a series of pulses based on the anticipated delays and irradiating a series of droplets at the irradiation site to create the EUV plasma.

The disclosed method and apparatus has been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above.

For example, different algorithms and/or logic circuits, perhaps more complex than those described herein, may be used. While certain examples have been provided of various configurations, components and parameters, one of skill in the art will be able to determine other possibilities that may be appropriate for a particular LPP EUV system. Different types of source lasers and line lasers, using different wavelengths than those described herein, as well as different sensors, focus lenses and other optics, or other components may be used. Finally, it will be apparent that different orientations of components, and distances between them, may be used in some embodiments.

It should also be appreciated that the described method and apparatus can be implemented in numerous ways, including as a process, an apparatus, or a system. The methods described herein may be implemented in part by program instructions for instructing a processor to perform such methods, and such instructions recorded on a computer readable storage medium such as a hard disk drive, floppy disk, optical disc such as a compact disc (CD) or digital versatile disc (DVD), flash memory, etc. In some embodiments the program instructions may be stored remotely and sent over a network via optical or electronic communication links. It should be noted that the order of the steps of the methods described herein may be altered and still be within the scope of the disclosure.

These and other variations upon the embodiments are intended to be covered by the present disclosure, which is limited only by the appended claims.

What is claimed is:

1. A method for modifying timing of firing a source laser in an extreme ultraviolet (EUV) laser produced plasma (LPP) light source having a droplet generator which releases a sequence of droplets, the source laser firing pulses at an irradiation site, the method comprising:

obtaining a first amount of EUV energy generated from a first pulse of the pulses that impacted a first droplet of the sequence of droplets;

determining, from the detected first amount of EUV energy, an anticipated delay of a second droplet of the sequence of droplets reaching the irradiation site; and modifying timing of firing the source laser for a second pulse of the pulses based on the anticipated delay of the second droplet so as to irradiate the second droplet when the second droplet reaches the irradiation site.

2. The method of claim 1, wherein determining the anticipated delay comprises:

obtaining a second amount of EUV energy generated from a third pulse of the pulses immediately preceding the first pulse that impacted a third droplet of the sequence of droplets immediately preceding the first droplet;

obtaining a third amount of EUV energy generated from a fourth pulse of the pulses immediately preceding the third pulse that impacted a fourth droplet of the sequence of droplets immediately preceding the third droplet; and applying a first scaling factor to the first amount of EUV energy to determine a first delay, a second scaling factor to the second amount of EUV energy to determine a second delay, and a third scaling factor to the third amount of EUV energy to determine a third delay; and combining the first delay, the second delay, and the third delay resulting in the anticipated delay.

3. The method of claim 2, wherein the first droplet, the third droplet, and the fourth droplet, at a given point in time, were positioned between a laser curtain and the irradiation site.

4. The method of claim 2, wherein the first scaling factor, the second scaling factor, and the third scaling factor have a 1/r relationship.

5. The method of claim 1, wherein determining the anticipated delay comprises:

obtaining a second amount of EUV energy generated from a third pulse of the pulses immediately preceding the first pulse that impacted a third droplet of the sequence of droplets immediately preceding the first droplet;

obtaining a third amount of EUV energy generated from a fourth pulse of the pulses immediately preceding the third pulse that impacted a fourth droplet of the sequence of droplets immediately preceding the third droplet;

applying a low pass filter to the first amount of EUV energy, the second amount of EUV energy, and the third amount of EUV energy; and applying a scaling factor to the output of the low pass filter resulting in the anticipated delay.

6. The method of claim 5, wherein the low pass filter comprises an infinite impulse response low pass filter.

7. The method of claim 1, wherein the anticipated delay is calculated using a gain parameter having units of $Watt^{-1}$.

8. A system for modifying timing of firing a source laser in an extreme ultraviolet (EUV) laser produced plasma (LPP) light source having a droplet generator which releases a sequence of droplets, the source laser firing pulses at an irradiation site, the system comprising:

an EUV energy detector configured to obtain a first amount of EUV energy generated from a first pulse of the pulses that impacted a first droplet of the sequence of droplets; and a delay module configured to:

determine, from the detected first amount of EUV energy, an anticipated delay of a second droplet of the sequence of droplets reaching the irradiation site, and instruct the source laser to modify timing of firing for a second pulse of the pulses based on the anticipated delay of the second droplet so as to irradiate the second droplet when the second droplet reaches the irradiation site.

9. The system of claim 8, wherein the delay module is configured to:

obtain a second amount of EUV energy generated from a third pulse of the pulses immediately preceding the first pulse that impacted a third droplet of the sequence of droplets immediately preceding the first droplet;

obtain a third amount of EUV energy generated from a fourth pulse of the pulses immediately preceding the third pulse that impacted a fourth droplet of the sequence of droplets immediately preceding the third droplet; and apply a first scaling factor to the first amount of EUV energy to determine a first delay, a second scaling factor to the second amount of EUV energy to determine a second delay, and a third scaling factor to the third amount of EUV energy to determine a third delay; and combine the first delay, the second delay, and the third delay resulting in the anticipated delay.

10. The system of claim 9, wherein the first droplet, the third droplet, and the fourth droplet, at a given point in time, were positioned between a laser curtain and the irradiation site.

11. The system of claim 9, wherein the first scaling factor, the second scaling factor, and the third scaling factor have a 1/r relationship.

12. The system of claim 8, wherein the delay module is configured to:

obtain a second amount of EUV energy generated from a third pulse of the pulses immediately preceding the first pulse that impacted a third droplet of the sequence of droplets immediately preceding the first droplet;

obtain a third amount of EUV energy generated from a fourth pulse of the pulses immediately preceding the third pulse that impacted a fourth droplet of the sequence of droplets immediately preceding the third droplet;

apply a low pass filter to the first amount of EUV energy, the second amount of EUV energy, and the third amount of EUV energy; and apply a scaling factor to the output of the low pass filter resulting in the anticipated delay.

13. The system of claim 12, wherein the low pass filter comprises an infinite impulse response low pass filter.

14. The system of claim 8, wherein the anticipated delay is calculated using a gain parameter having units of $Watt^{-1}$.

15. A non-transitory machine-readable medium having instructions embodied thereon, the instructions executable by one or more machines to perform operations for modifying timing of firing a source laser in an extreme ultraviolet (EUV) laser produced plasma (LPP) light source having a droplet generator which releases a sequence of droplets, the source laser firing pulses at an irradiation site, the operations comprising:

obtaining a first amount of EUV energy generated from a first pulse of the pulses that impacted a first droplet of the sequence of droplets;

determining, from the detected first amount of EUV energy, an anticipated delay of a second droplet of the sequence of droplets reaching the irradiation site; and modifying timing of firing the source laser for a second pulse of the pulses based on the anticipated delay of the second droplet so as to irradiate the second droplet when the second droplet reaches the irradiation site.

16. The non-transitory machine-readable medium of claim 15, wherein determining the anticipated delay comprises:

obtaining a second amount of EUV energy generated from a third pulse of the pulses immediately preceding the first pulse that impacted a third droplet of the sequence of droplets immediately preceding the first droplet;

obtaining a third amount of EUV energy generated from a fourth pulse of the pulses immediately preceding the third pulse that impacted a fourth droplet of the sequence of droplets immediately preceding the third droplet; and applying a first scaling factor to the first amount of EUV energy to determine a first delay, a second scaling factor to the second amount of EUV energy to determine a second delay, and a third scaling factor to the third amount of EUV energy to determine a third delay; and combining the first delay, the second delay, and the third delay resulting in the anticipated delay.

17. The non-transitory machine-readable medium of claim 16, wherein the first scaling factor, the second scaling factor, and the third scaling factor have a 1/r relationship.

18. The non-transitory machine-readable medium of claim 15, wherein determining the anticipated delay comprises:

obtaining a second amount of EUV energy generated from a third pulse of the pulses immediately preceding the first pulse that impacted a third droplet of the sequence of droplets immediately preceding the first droplet;

obtaining a third amount of EUV energy generated from a fourth pulse of the pulses immediately preceding the third pulse that impacted a fourth droplet of the sequence of droplets immediately preceding the third droplet;

applying a low pass filter to the first amount of EUV energy, the second amount of EUV energy, and the third amount of EUV energy; and applying a scaling factor to the output of the low pass filter resulting in the anticipated delay.

19. The non-transitory machine-readable medium of claim 18, wherein the low pass filter comprises an infinite impulse response low pass filter.

20. The non-transitory machine-readable medium of claim 15, wherein the anticipated delay is calculated using a gain parameter having units of $Watt^{-1}$.

* * * * *